US011059633B2

(12) United States Patent
Gosling et al.

(10) Patent No.: US 11,059,633 B2
(45) Date of Patent: Jul. 13, 2021

(54) FLIP-TOP CLOSURE FOR CONTAINER

(71) Applicant: Cheer Pack North America, West Bridgewater, MA (US)

(72) Inventors: Stephen L. Gosling, Hingham, MA (US); David A. Williamson, Plymouth, MA (US); Peter J. Walters, Barrington, IL (US)

(73) Assignee: Cheer Pack North America, West Bridgewater, MA (US)

( * ) Notice: Subject to any disclaimer, the term of this patent is extended or adjusted under 35 U.S.C. 154(b) by 0 days.

(21) Appl. No.: 16/670,266

(22) Filed: Oct. 31, 2019

(65) Prior Publication Data

US 2021/0130050 A1 May 6, 2021

(51) Int. Cl.
*B65D 47/08* (2006.01)
*B65D 55/02* (2006.01)

(52) U.S. Cl.
CPC ..... *B65D 47/0838* (2013.01); *B65D 55/02* (2013.01)

(58) Field of Classification Search
CPC ..... B65D 47/0838; B65D 55/02
USPC ..... 222/153.06, 153.14, 546, 556
See application file for complete search history.

(56) References Cited

U.S. PATENT DOCUMENTS

| | | | |
|---|---|---|---|
| 2,169,686 | A | 8/1939 | Fabrice |
| 2,470,057 | A | 5/1949 | Spender |
| 2,892,572 | A | 6/1959 | Fredette et al. |
| 2,990,078 | A | 6/1961 | Fields |
| 3,199,702 | A | 8/1965 | Fischbach |
| 3,259,233 | A | 7/1966 | Beeman |
| 3,363,793 | A | 1/1968 | Simons |
| 3,416,688 | A | 12/1968 | Fanning |
| 3,460,703 | A | 8/1969 | Leftault, Jr. |
| 3,484,012 | A | 12/1969 | White et al. |
| 3,493,140 | A | 2/1970 | Macneill |
| 3,601,273 | A | 8/1971 | Kutcher |
| 3,750,821 | A | 8/1973 | Sourbet et al. |
| 3,796,338 | A | 3/1974 | Wilton |

(Continued)

FOREIGN PATENT DOCUMENTS

| | | | |
|---|---|---|---|
| CA | 1270359 | A | 6/1990 |
| CN | 203473489 | U | 3/2014 |

(Continued)

OTHER PUBLICATIONS

US 4,448,317 A, 05/1984, Thompson (withdrawn)
US 7,762,433 B2, 07/2010, Koh (withdrawn)

*Primary Examiner* — Michael J. Melaragno
(74) *Attorney, Agent, or Firm* — Ulmer & Berne LLP

(57) ABSTRACT

A flip-top closure includes a spout, a lid, and a hinge member. The spout is configured for coupling with a fitment of a container. The spout includes a base portion, a tip portion, and a main body. The base portion defines a retention receptacle and an inlet. The inlet includes a first diameter. The tip portion extends from the base portion and defines a dispensation outlet. The base portion and the tip portion cooperate to define a passageway that extends between the inlet and the dispensation outlet. The lid includes a main body that includes an upper wall and a sidewall that cooperate to define an interior. The hinge member is coupled with each of the spout and the sidewall of the main body. The hinge member is configured to facilitate pivoting of the lid between a closed position and an opened position.

15 Claims, 9 Drawing Sheets

(56) References Cited

U.S. PATENT DOCUMENTS 3,805,987 A 4/1974 Horvath
3,837,519 A 9/1974 Perry
3,850,329 A 11/1974 Robinson
3,904,062 A 9/1975 Grussen
3,913,772 A 10/1975 Ochs
3,924,769 A 12/1975 Fillmore
3,957,169 A 5/1976 Coursaut
3,967,745 A 7/1976 Julian
3,968,894 A 7/1976 Herrmann
4,021,524 A 5/1977 Grimsley
4,062,466 A 12/1977 Conti
4,098,419 A 7/1978 Virog, Jr. et al.
4,103,900 A 8/1978 Wittersheim
4,126,240 A 11/1978 Brach
4,147,268 A 4/1979 Patel et al.
4,153,174 A 5/1979 Keeler
4,156,490 A 5/1979 Peraboni
4,176,755 A 12/1979 Winchell
4,177,906 A 12/1979 Von Hagel
4,206,851 A 6/1980 Ostrowsky
4,241,842 A 12/1980 Toeppen
4,261,478 A 4/1981 Summers
4,269,320 A 5/1981 Virog, Jr. et al.
4,276,988 A 7/1981 Kimm et al.
4,278,180 A 7/1981 Willis
4,299,328 A 11/1981 Ochs et al.
4,346,811 A 8/1982 Hilaire
4,347,939 A 9/1982 Upton
4,372,456 A 2/1983 Guala
4,378,894 A 4/1983 Willis et al.
4,394,918 A 7/1983 Grussen
4,401,227 A 8/1983 Pehr
4,402,418 A 9/1983 Ostrowsky
4,418,828 A 12/1983 Wilde et al.
4,436,213 A 3/1984 Paul, Jr. et al.
4,446,979 A 5/1984 Gach et al.
4,452,363 A 6/1984 Davis
4,456,139 A 6/1984 Kent
4,457,437 A 7/1984 Heath
4,458,821 A 7/1984 Ostrowsky
4,458,822 A 7/1984 Ostrowsky
4,460,100 A 7/1984 Libit
4,461,391 A 7/1984 Davis
4,463,878 A 8/1984 Crone
4,470,513 A 9/1984 Ostrowsky
4,471,878 A 9/1984 Davis et al.
4,478,343 A 10/1984 Ostrowsky
4,479,586 A 10/1984 Csaszar
4,480,761 A 11/1984 Aichinger
4,489,843 A 12/1984 Drozd
4,501,373 A 2/1985 Heinlein
4,503,985 A 3/1985 Swartzbaugh et al.
4,503,986 A 3/1985 Nixdorff et al.
4,505,401 A 3/1985 Berglund
4,506,795 A 3/1985 Herr
4,511,053 A 4/1985 Brandes et al.
4,511,054 A 4/1985 Shank
4,519,514 A 5/1985 Agbay et al.
4,519,516 A 5/1985 Amos
4,526,283 A 7/1985 Skinner
4,527,700 A 7/1985 Jupin et al.
4,527,704 A 7/1985 Swartzbaugh
4,527,706 A 7/1985 Swartzbaugh et al.
4,530,436 A 7/1985 Wiedmer
4,530,438 A 7/1985 McDevitt
4,534,479 A 8/1985 Conti
4,534,480 A 8/1985 Santostasi et al.
4,537,319 A 8/1985 Whitney
4,540,098 A 9/1985 Luker
4,546,893 A 10/1985 Stull
4,548,329 A 10/1985 Curry
4,550,844 A 11/1985 Lininger
4,555,039 A 11/1985 Conti
4,560,076 A 12/1985 Boik
4,565,293 A 1/1986 Jonas
4,567,991 A 2/1986 Anderson
4,567,993 A 2/1986 Albrecht et al.
4,570,825 A 2/1986 Stull
4,572,385 A 2/1986 Luker
4,572,387 A 2/1986 Luker et al.
4,572,388 A 2/1986 Luker et al.
4,572,389 A 2/1986 Gach
4,576,298 A 3/1986 Boik
4,577,770 A 3/1986 Wright
4,579,241 A 4/1986 Hayes
4,597,500 A 7/1986 Stubbs
4,598,833 A 7/1986 Herr
4,603,785 A 8/1986 Gach
4,609,115 A 9/1986 Moore et al.
4,613,052 A 9/1986 Gregory et al.
4,618,121 A 10/1986 Conti
4,625,875 A 12/1986 Carr et al.
4,630,743 A 12/1986 Wright
4,638,917 A 1/1987 Persch
4,640,427 A 2/1987 Marino et al.
4,643,321 A 2/1987 Gach
4,645,087 A 2/1987 Kusz
4,653,657 A 3/1987 Papavasilopoulos
4,655,356 A 4/1987 Fuchs
4,657,153 A 4/1987 Hayes
4,664,278 A 5/1987 Barriac
4,666,053 A 5/1987 Corcoran et al.
4,666,063 A 5/1987 Holoubek et al.
4,667,836 A 5/1987 McLaren
4,667,838 A 5/1987 Yeager
4,669,124 A 5/1987 Kimura
4,669,623 A 6/1987 Csaszar
4,694,970 A 9/1987 Hayes
4,697,714 A 10/1987 Towns et al.
4,702,383 A 10/1987 Wender
4,706,828 A 11/1987 Zinnbauer
4,709,824 A 12/1987 Thompson
4,715,506 A 12/1987 McLaren
4,726,482 A 2/1988 Barriac
4,726,483 A 2/1988 Drozd
4,727,998 A 3/1988 Simon
4,732,289 A 3/1988 Granat et al.
4,733,787 A 3/1988 Knopf et al.
4,742,927 A 5/1988 Tierney et al.
4,744,479 A 5/1988 Schottli
4,749,095 A 6/1988 Rote
4,752,013 A 6/1988 Miller et al.
4,753,360 A 6/1988 Baxter
4,756,438 A 7/1988 Ryder
4,757,911 A 7/1988 Larkin et al.
4,759,456 A 7/1988 Kusz
4,771,904 A 9/1988 Peme et al.
4,771,923 A 9/1988 Zinnbauer
4,784,281 A 11/1988 Rozenberg
4,793,499 A 12/1988 Dubach et al.
4,796,770 A 1/1989 Begley
4,801,030 A 1/1989 Barriac
4,801,031 A 1/1989 Barriac
4,805,791 A 2/1989 Begley
4,805,792 A 2/1989 Lecinski
4,807,770 A 2/1989 Barriac
4,807,771 A 2/1989 Roy et al.
4,811,856 A 3/1989 Fischman
4,813,561 A 3/1989 Ochs
4,813,562 A 3/1989 Begley
4,815,617 A 3/1989 Cullum
4,828,127 A 5/1989 Young et al.
4,830,208 A 5/1989 Osting et al.
4,844,250 A 7/1989 Holoubek et al.
4,844,272 A 7/1989 Dutt
4,848,613 A 7/1989 Nofer
4,848,614 A 7/1989 Csaszar
4,856,665 A 8/1989 Dutt et al.
4,863,050 A 9/1989 Perry
4,884,706 A 12/1989 Julian
4,890,754 A 1/1990 Dorn et al.
4,895,266 A 1/1990 Begley
4,899,898 A 2/1990 Thompson
4,907,708 A 3/1990 Csaszar

(56) References Cited

U.S. PATENT DOCUMENTS 4,913,300 A 4/1990 Wiedmer et al.
4,919,285 A 4/1990 Roof et al.
4,923,073 A 5/1990 Wilde
4,930,647 A 6/1990 Dutt et al.
4,936,474 A 6/1990 Szczesniak et al.
4,936,475 A 6/1990 Montgomery
4,938,370 A 7/1990 McBride
4,946,055 A 8/1990 Towns et al.
4,967,920 A 11/1990 Dahl
4,978,016 A 12/1990 Hayes
4,981,230 A 1/1991 Marshall et al.
4,984,699 A 1/1991 Zalut
4,984,701 A 1/1991 Margaria
4,986,430 A 1/1991 Dutt
4,993,570 A 2/1991 Julian et al.
4,993,571 A 2/1991 Conti
4,998,988 A 3/1991 Zinnbauer
5,004,110 A 4/1991 Osip et al.
5,004,112 A 4/1991 McBride
5,005,720 A 4/1991 Heilman
5,009,323 A 4/1991 Montgomery et al.
5,027,964 A 7/1991 Banich
5,033,632 A 7/1991 Mattia et al.
5,040,692 A 8/1991 Julian
5,050,753 A 9/1991 Trump et al.
5,056,675 A 10/1991 Julian
5,065,883 A 11/1991 Udell
5,097,974 A 3/1992 Rozenberg
5,100,011 A 3/1992 Maietta
5,107,998 A 4/1992 Zumbuhl
5,111,947 A 5/1992 Patterson
5,115,932 A 5/1992 Schneider
5,123,561 A 6/1992 Gross
5,129,530 A 7/1992 Fuchs
5,131,549 A 7/1992 Battegazzore
5,131,550 A 7/1992 Thompson
5,133,486 A 7/1992 Moore et al.
5,135,123 A 8/1992 Nairn et al.
5,137,163 A 8/1992 Moore
5,145,078 A 9/1992 Hannon et al.
5,167,335 A 12/1992 McBride et al.
5,174,465 A 12/1992 Luch et al.
5,190,177 A 3/1993 Collins
5,190,178 A 3/1993 Luch
5,203,838 A 4/1993 Schneider
5,207,783 A 5/1993 Burton
5,242,068 A 9/1993 McCandless
5,246,125 A 9/1993 Julian
5,248,050 A 9/1993 Janousch et al.
5,255,813 A 10/1993 Berggren et al.
5,263,600 A 11/1993 Henning
5,271,512 A 12/1993 Ekkert
5,271,519 A 12/1993 Adams et al.
5,282,540 A 2/1994 Beck
5,285,912 A 2/1994 Molinaro
5,295,600 A 3/1994 Kowal
5,307,945 A 5/1994 Hidding et al.
5,307,955 A 5/1994 Viegas
5,310,069 A 5/1994 Ingram et al.
5,314,085 A 5/1994 Collado Bonet
5,318,192 A 6/1994 Rebeyrolle et al.
5,320,234 A 6/1994 Kamath
5,320,235 A 6/1994 Joyce
5,328,044 A 7/1994 Rohrs et al.
5,348,182 A 9/1994 Luch
5,348,184 A 9/1994 Adams et al.
5,356,019 A 10/1994 Kelly
5,356,020 A 10/1994 Thompson
5,360,126 A 11/1994 Snyder et al.
5,373,954 A 12/1994 Julian
5,397,013 A 3/1995 Adams et al.
5,400,913 A 3/1995 Kelly
5,402,901 A 4/1995 Carvalheiro et al.
5,413,235 A 5/1995 Decelles
5,445,284 A 8/1995 Guest
5,450,973 A 9/1995 Ellis et al.
5,456,374 A 10/1995 Beck
5,456,375 A 10/1995 May
5,465,858 A 11/1995 Gargione
5,472,106 A 12/1995 Nofer
5,484,071 A 1/1996 Zumbuhl
5,487,481 A 1/1996 Sander et al.
5,488,888 A 2/1996 Kowal
5,501,349 A 3/1996 McCandless
5,507,416 A 4/1996 Rapchak et al.
5,511,677 A 4/1996 Oder
5,513,763 A 5/1996 Adams et al.
5,540,344 A 7/1996 Rosenthal et al.
5,547,092 A 8/1996 Thompson
5,570,798 A 11/1996 Hayashida et al.
5,573,130 A 11/1996 Chanal et al.
5,575,967 A 11/1996 Julian
5,588,562 A 12/1996 Sander et al.
5,597,082 A 1/1997 Luch et al.
5,609,262 A 3/1997 Trout
5,641,084 A 6/1997 Rice
5,642,825 A 7/1997 Wohlgemuth
5,648,037 A 7/1997 Franchet et al.
5,655,685 A 8/1997 Carr et al.
5,657,889 A 8/1997 Guglielmini
5,667,085 A 9/1997 Ogden et al.
5,667,088 A 9/1997 King et al.
5,676,269 A 10/1997 Blake et al.
5,678,714 A 10/1997 Guglielmini
5,683,016 A 11/1997 Santagiuliana
5,690,243 A 11/1997 Molinaro
5,695,083 A 12/1997 Obadia
5,699,924 A 12/1997 Mascio et al.
5,711,443 A 1/1998 Bennett et al.
5,715,959 A 2/1998 Pfefferkorn et al.
5,716,678 A 2/1998 Rockrath et al.
5,722,547 A 3/1998 Shankland
5,725,115 A 3/1998 Bosl et al.
5,738,231 A 4/1998 Montgomery
5,755,346 A 5/1998 Ekkert
5,775,527 A 7/1998 Bosl et al.
5,775,528 A 7/1998 Wohlgemuth et al.
5,799,840 A 9/1998 Mogard
5,813,553 A 9/1998 Herr et al.
5,819,965 A 10/1998 King et al.
5,823,377 A 10/1998 Krautkramer
5,829,611 A 11/1998 Beck
5,846,471 A 12/1998 Thakor et al.
5,853,095 A 12/1998 Marshall et al.
5,860,542 A 1/1999 Takamatsu
5,862,953 A 1/1999 Long
5,875,907 A 3/1999 Lay
5,884,788 A 3/1999 Wilde
5,891,380 A 4/1999 Larue et al.
5,893,474 A 4/1999 Herrmann et al.
5,893,475 A 4/1999 May
5,913,437 A 6/1999 Ma
5,927,527 A 7/1999 Montgomery et al.
5,950,849 A 9/1999 Ekkert et al.
5,950,850 A 9/1999 Takamatsu et al.
5,957,315 A 9/1999 Kaitsuka
5,964,363 A 10/1999 Kelly et al.
5,967,351 A 10/1999 Ekkert
5,971,182 A 10/1999 Berge et al.
5,975,320 A 11/1999 Bietzer et al.
5,979,681 A 11/1999 PatrickJean-Luc et al.
5,979,682 A 11/1999 Zumbuhl
5,984,125 A 11/1999 Price et al.
5,992,657 A 11/1999 Friedman
5,992,659 A 11/1999 Nofer et al.
5,996,859 A 12/1999 Beck
6,000,568 A 12/1999 Verter
6,000,848 A 12/1999 Massioui
6,016,931 A 1/2000 Ohmi et al.
6,024,256 A 2/2000 Beck et al.
6,039,196 A 3/2000 Ekkert et al.
6,044,995 A 4/2000 Dai
6,050,436 A 4/2000 Bennett et al.
6,053,344 A 4/2000 Gregory et al.

(56) References Cited

U.S. PATENT DOCUMENTS 6,059,134 A 5/2000 Long
6,065,651 A 5/2000 Tedeschi, Jr. et al.
6,068,151 A 5/2000 Recendez
6,085,921 A 7/2000 Brown
6,089,390 A 7/2000 Druitt et al.
6,112,923 A 9/2000 Ma
6,116,442 A 9/2000 Higgins
6,116,443 A 9/2000 Parrinello
6,116,477 A 9/2000 Kreiseder et al.
6,126,025 A 10/2000 Recendez
6,152,316 A 11/2000 Niese
6,152,322 A 11/2000 Marino
6,173,853 B1 1/2001 Luch
6,213,321 B1 4/2001 Zumbuhl
6,213,350 B1 4/2001 Polykandriotis
6,223,924 B1 5/2001 Ek et al.
6,253,940 B1 7/2001 Graham et al.
6,264,052 B1 7/2001 Schmitz
6,269,986 B1 8/2001 Gross
6,308,848 B1 10/2001 Parrinello
6,325,227 B1 12/2001 Ekkert
6,347,716 B1 2/2002 Nofer et al.
6,360,909 B1 3/2002 Bridge
6,364,164 B1 4/2002 Troiano
6,371,317 B1 4/2002 Krueger
6,381,928 B1 5/2002 Gregory
6,382,444 B1 5/2002 Nyman
6,394,294 B1 5/2002 Briere
6,402,019 B1 6/2002 Casale
6,405,886 B1 6/2002 Gearhart et al.
6,409,054 B1 * 6/2002 Garibaldi ..... B65D 47/0838 222/524
6,419,101 B1 7/2002 Hessel et al.
6,431,404 B1 8/2002 Long
6,439,412 B2 8/2002 Luch
6,439,429 B1 8/2002 Gross
6,474,491 B1 11/2002 Benoit-Gonin et al.
6,478,184 B2 11/2002 Berge et al.
6,484,896 B2 11/2002 Ma
6,510,971 B1 1/2003 Martin
6,536,586 B2 3/2003 Nakao et al.
6,550,626 B1 4/2003 Randall
6,551,093 B2 4/2003 Taha
6,557,714 B2 5/2003 Babcock et al.
6,561,370 B1 5/2003 Escobar-Harrity
6,564,958 B1 5/2003 Ramsey et al.
6,568,548 B1 5/2003 Minnette et al.
6,575,319 B2 6/2003 Zumbuhl
6,581,792 B1 6/2003 Limanjaya
6,631,820 B2 10/2003 Harrold et al.
6,644,487 B2 11/2003 Smith et al.
6,655,553 B2 12/2003 Staniszewski et al.
6,659,297 B2 12/2003 Gregory et al.
6,677,397 B1 1/2004 Baranowski et al.
6,705,479 B2 3/2004 Druitt et al.
6,726,042 B2 4/2004 Schweigert et al.
6,736,280 B1 5/2004 Zapata
6,739,466 B1 5/2004 Culley
6,766,916 B2 7/2004 Ma
6,769,575 B1 8/2004 Long
6,772,902 B1 8/2004 White
6,821,239 B2 11/2004 Hierzer et al.
6,851,576 B2 2/2005 Dubach
6,871,752 B2 3/2005 Montgomery
6,913,158 B1 7/2005 Boesl et al.
6,926,162 B1 8/2005 Culley
6,926,165 B2 8/2005 Conti
6,942,114 B2 9/2005 Nishida
6,948,631 B2 9/2005 Lafond et al.
6,968,968 B2 11/2005 Buckley et al.
6,974,046 B2 12/2005 Shenkar
6,976,607 B2 12/2005 Benoit-Gonin et al.
6,981,607 B2 1/2006 Lown et al.
6,981,614 B2 1/2006 Niggemyer
6,986,434 B1 1/2006 Getsy et al.
7,059,485 B1 6/2006 Reidenbach
7,077,278 B2 7/2006 Dubach
7,121,419 B2 10/2006 Ferry et al.
7,121,431 B2 10/2006 Duke
7,152,760 B1 12/2006 Peabody
7,156,247 B2 1/2007 Laburu
7,198,170 B2 4/2007 Herr
7,210,593 B2 5/2007 Stull et al.
7,222,741 B2 5/2007 Chmela et al.
7,246,713 B2 7/2007 King
7,303,088 B2 12/2007 Sawyer et al.
7,322,493 B2 1/2008 Skillin
7,344,039 B2 3/2008 Bixler et al.
7,413,097 B1 8/2008 Adams
7,451,885 B2 11/2008 Nyman et al.
7,451,898 B2 11/2008 Seidita
7,479,887 B2 1/2009 Meyer
7,503,468 B2 3/2009 Druitt et al.
7,549,559 B2 6/2009 Conroy et al.
7,575,123 B2 8/2009 Laveault et al.
7,578,404 B2 8/2009 Ekkert
7,588,155 B2 9/2009 Williams
7,591,398 B2 9/2009 Pritikin et al.
7,607,549 B2 10/2009 Morini
7,611,025 B2 11/2009 Nusbaum et al.
7,614,514 B2 11/2009 Fuchs
7,617,954 B2 11/2009 Skillin
7,628,283 B2 12/2009 Shingle
7,637,402 B2 12/2009 Romanov et al.
7,677,422 B2 3/2010 Lee
7,694,837 B2 4/2010 Robertson et al.
7,703,621 B2 4/2010 Evans et al.
7,712,619 B2 5/2010 Schwarz et al.
7,721,907 B2 5/2010 Keung
7,735,666 B2 6/2010 Niwa et al.
7,735,699 B2 6/2010 Brannon et al.
7,753,233 B2 7/2010 Umenaka
7,762,438 B2 7/2010 Skillin
7,772,981 B1 8/2010 Lambert et al.
7,775,395 B2 8/2010 Zeiler et al.
7,810,663 B2 10/2010 Young
7,857,154 B2 12/2010 Pedlar
7,882,977 B2 2/2011 Johnson
7,891,510 B2 2/2011 Loughrin et al.
7,931,167 B2 4/2011 Chmela
7,959,045 B2 6/2011 Kuge et al.
7,988,004 B1 8/2011 Marret et al.
8,033,419 B1 10/2011 Szekely
8,056,749 B2 11/2011 Robinson
8,100,289 B1 1/2012 Tobias
8,215,507 B2 7/2012 Dubs et al.
8,245,870 B2 8/2012 McKinney et al.
8,272,526 B1 9/2012 Vovan et al.
8,297,461 B2 10/2012 Evans et al.
8,302,792 B2 11/2012 Logel et al.
8,302,793 B2 11/2012 Schomer
8,302,794 B2 11/2012 Russell
8,336,732 B1 12/2012 Tobias
8,376,182 B2 2/2013 Lepage
8,381,925 B2 2/2013 Skillin et al.
8,413,832 B2 * 4/2013 Mazurkiewicz ..... B65D 55/024 220/266
D681,462 S 5/2013 Taylor
8,434,639 B2 5/2013 Markert
8,439,212 B2 5/2013 Clodfelter et al.
8,443,993 B1 5/2013 Desselle
8,453,856 B2 6/2013 Skelton et al.
8,469,241 B2 6/2013 Romanov et al.
8,479,936 B2 7/2013 Gruenwald et al.
8,485,374 B2 7/2013 Gevers et al.
8,490,804 B2 7/2013 Benoit-Gonin et al.
8,499,950 B2 8/2013 Win
8,517,194 B2 8/2013 Bloom et al.
8,528,758 B2 9/2013 Morlot et al.
8,544,666 B2 10/2013 Velmer et al.
8,608,008 B2 12/2013 Gingras et al.
8,631,957 B2 1/2014 Dart et al.
8,646,633 B2 2/2014 Huntington et al.
8,646,659 B2 2/2014 Swanick

(56) References Cited

U.S. PATENT DOCUMENTS 8,663,412 B2 3/2014 Detrois et al.
8,684,203 B2 4/2014 Krautkraemer
8,695,857 B2 4/2014 Hamamoto et al.
8,720,716 B2 5/2014 Campbell
8,757,410 B2 6/2014 Takashima et al.
8,807,360 B2 8/2014 Erspamer et al.
8,833,584 B2 9/2014 Groubert
8,834,024 B2 9/2014 Umenaka
D718,127 S 11/2014 Moriyama et al.
8,905,252 B2 12/2014 Latham et al.
8,944,265 B2 2/2015 Blake
9,010,555 B2 4/2015 Luzzato et al.
9,017,977 B2 4/2015 Marliere
9,033,153 B2 5/2015 Lambalot et al.
9,051,090 B2 6/2015 Antler et al.
9,051,092 B1 6/2015 Monbarren et al.
9,102,448 B2 8/2015 Skelton et al.
9,120,606 B2 9/2015 Walter et al.
9,187,219 B2 11/2015 Brannon et al.
9,238,530 B2 1/2016 Possell et al.
9,273,199 B2 3/2016 Domoy et al.
9,290,306 B2 3/2016 Totten
9,290,973 B2 3/2016 Quinn
9,309,029 B2 4/2016 Incorvia et al.
9,327,878 B2 5/2016 Schueller et al.
9,333,289 B1 5/2016 Hirschmann et al.
9,334,097 B2 5/2016 Skillin et al.
9,371,162 B2 6/2016 Walunis et al.
9,382,045 B2 7/2016 Wohlgenannt et al.
9,415,909 B2 8/2016 Druitt et al.
9,439,523 B2 9/2016 Naesje et al.
9,475,618 B2 10/2016 Wohlgenannt
9,475,622 B2 10/2016 Skillin et al.
9,493,283 B2 11/2016 Tuyn
9,510,701 B1 12/2016 Larcher et al.
9,533,802 B2 1/2017 Berge
9,550,611 B2 1/2017 Hodge
9,555,426 B2 1/2017 Skillin
9,567,140 B2 2/2017 Backaert et al.
9,567,143 B2 2/2017 Carvajal et al.
9,592,937 B1 3/2017 Wang
9,598,209 B1 3/2017 Maldonado
9,604,836 B2 3/2017 Nini
9,630,754 B2 4/2017 Schmidt et al.
9,650,184 B2 5/2017 Fily et al.
9,669,963 B2 6/2017 Shirley et al.
9,701,451 B2 7/2017 Skillin et al.
9,706,886 B2 7/2017 Pierson
9,724,629 B2 8/2017 Lane
D796,326 S 9/2017 Ichikawa et al.
9,758,281 B2 9/2017 Glaser et al.
9,764,879 B2 9/2017 Koenigseder et al.
9,771,189 B2 9/2017 Miksovsky et al.
9,776,779 B2 10/2017 Campbell
9,821,934 B2 11/2017 Bevan et al.
9,828,146 B2 11/2017 Loukov
9,850,044 B2 12/2017 Muhlemann
9,868,570 B2 1/2018 Ferrari et al.
9,884,706 B1 2/2018 Skillin et al.
9,926,185 B2 3/2018 Davis et al.
9,938,050 B2 4/2018 Berge
9,975,669 B2 5/2018 Pellerin et al.
10,065,781 B2 9/2018 Ichikawa et al.
10,124,936 B2 11/2018 Santarelli et al.
10,137,447 B1 11/2018 Motadel et al.
10,138,043 B2 11/2018 Mazurkiewicz et al.
10,147,341 B2 12/2018 Berbert et al.
10,173,811 B2 1/2019 Stevens et al.
10,183,788 B2 1/2019 Janis et al.
10,183,791 B2 1/2019 Friedrich et al.
10,201,821 B2 2/2019 Brannon et al.
10,214,325 B2 2/2019 Rognard et al.
10,214,332 B2 2/2019 Eyal
10,246,233 B2 4/2019 Fagone
10,252,845 B2 4/2019 Rognard et al.
10,377,534 B2 8/2019 Hanan
10,421,592 B2 9/2019 Genaw, Jr. et al.
10,442,591 B2 10/2019 Rognard et al.
2001/0015341 A1 8/2001 Higgins
2001/0030164 A1 10/2001 Corvaglia
2002/0043142 A1 4/2002 Zumbuhl
2002/0070218 A1 6/2002 Mozes
2002/0148803 A1 10/2002 Chang
2003/0057209 A1 3/2003 Seelhofer
2003/0071042 A1 4/2003 Adams
2003/0102280 A1 6/2003 Odet et al.
2003/0136784 A1 7/2003 Smith
2003/0189065 A1 10/2003 Stull et al.
2003/0192853 A1 10/2003 Zapata
2003/0217987 A1 11/2003 Pehr
2004/0026288 A1 2/2004 Zumbuhl
2004/0040928 A1 3/2004 Noonan
2004/0045926 A1 3/2004 Williamson
2004/0055990 A1 3/2004 Dubach
2004/0069738 A1 4/2004 Orth et al.
2004/0074861 A1 4/2004 Chuang et al.
2004/0094501 A1 5/2004 Miege et al.
2004/0211744 A1 10/2004 Marzokah
2004/0238540 A1 12/2004 Jackel et al.
2004/0245286 A1 12/2004 Lee
2005/0077264 A1 4/2005 Fuchs
2005/0092641 A1 5/2005 Marsden et al.
2005/0109782 A1 5/2005 Biesecker et al.
2005/0199573 A1 9/2005 Last
2005/0224445 A1 10/2005 Gancia
2005/0230342 A1 10/2005 Folchini et al.
2005/0247714 A1 11/2005 Backes et al.
2005/0252878 A1 11/2005 Babcock
2005/0269282 A1 12/2005 Luch
2005/0279727 A1 12/2005 Graswald et al.
2006/0006130 A1 1/2006 Romer et al.
2006/0006578 A1 1/2006 Johnson et al.
2006/0016819 A1 1/2006 Paslawski et al.
2006/0060555 A1 3/2006 Ma et al.
2006/0124575 A1 6/2006 Mavin et al.
2006/0163193 A1 7/2006 Smeyak et al.
2006/0207960 A1 9/2006 Bastero Lopez
2006/0226146 A1 10/2006 Haberman
2006/0261028 A1 11/2006 Dubach
2007/0012646 A1 1/2007 Horike
2007/0051690 A1 3/2007 Hidding
2007/0051691 A1 3/2007 Hidding
2007/0075030 A1 4/2007 Delli Venneri
2007/0102389 A1 5/2007 Hoepner et al.
2007/0102390 A1* 5/2007 Hoepner ..... B65D 47/0885 215/235
2007/0131641 A1 6/2007 Higgins
2007/0160792 A1 7/2007 Human
2007/0251909 A1 11/2007 Decelles et al.
2007/0257002 A1 11/2007 Pucci
2007/0267381 A1 11/2007 Schmidt et al.
2007/0278256 A1 12/2007 Law et al.
2007/0284392 A1 12/2007 Kaess et al.
2007/0284398 A1 12/2007 Baughman et al.
2008/0000923 A1 1/2008 Berge
2008/0011704 A1 1/2008 Van Ryn
2008/0073382 A1 3/2008 Higgins
2008/0105640 A1 5/2008 Ott
2008/0105642 A1 5/2008 Bassi
2008/0116162 A1 5/2008 Penny
2008/0173611 A1 7/2008 Neputy et al.
2008/0199108 A1 8/2008 Rogers
2008/0210745 A1 9/2008 Rigling
2008/0223813 A1 9/2008 Flak et al.
2008/0272083 A1 11/2008 Druitt
2009/0045158 A1 2/2009 Suriol
2009/0050596 A1 2/2009 Fuchs
2009/0057260 A1 3/2009 Mohindra
2009/0057261 A1 3/2009 Ma et al.
2009/0120936 A1 5/2009 Zauser et al.
2009/0134112 A1 5/2009 Reeves
2009/0139954 A1 6/2009 Ekkert
2009/0139955 A1 6/2009 Fraser et al.

(56) References Cited

U.S. PATENT DOCUMENTS

| | | | | |
|---|---|---|---|---|
| 2009/0152269 | A1* | 6/2009 | Pucci | B65D 47/0823 220/254.3 |
| 2009/0198540 | A1 | 8/2009 | Kienzle et al. | |
| 2009/0283492 | A1 | 11/2009 | Molinaro et al. | |
| 2010/0126990 | A1 | 5/2010 | Fontana | |
| 2010/0140210 | A1 | 6/2010 | Blake | |
| 2010/0213213 | A1 | 8/2010 | Albers et al. | |
| 2010/0224643 | A1 | 9/2010 | Daggett | |
| 2010/0252556 | A1 | 10/2010 | Krautkramer | |
| 2010/0264145 | A1* | 10/2010 | Benoit-Gonin | B65D 55/024 220/265 |
| 2011/0062159 | A1 | 3/2011 | Khubani | |
| 2011/0089133 | A1 | 4/2011 | Dygert et al. | |
| 2011/0132941 | A1 | 6/2011 | Kim | |
| 2011/0137272 | A1 | 6/2011 | Adams | |
| 2011/0163135 | A1* | 7/2011 | Herald | B65D 47/0876 222/556 |
| 2011/0210122 | A1 | 9/2011 | Benoit-Gonin et al. | |
| 2011/0297682 | A1 | 12/2011 | Kwon | |
| 2011/0303670 | A1 | 12/2011 | Baker | |
| 2012/0024877 | A1 | 2/2012 | Tobias | |
| 2012/0067922 | A1* | 3/2012 | Benoit-Gonin | B65D 55/024 222/153.06 |
| 2012/0080399 | A1 | 4/2012 | Barlics et al. | |
| 2012/0111822 | A1 | 5/2012 | Prozumenschikov | |
| 2012/0211493 | A1 | 8/2012 | Daggett | |
| 2012/0223044 | A1 | 9/2012 | Scott, III et al. | |
| 2013/0001185 | A1 | 1/2013 | Antler et al. | |
| 2013/0043207 | A1 | 2/2013 | Luzzato et al. | |
| 2013/0058595 | A1 | 3/2013 | Ekenhorst | |
| 2013/0119092 | A1 | 5/2013 | Kuwagaki et al. | |
| 2013/0136382 | A1 | 5/2013 | Barron | |
| 2013/0299445 | A1 | 11/2013 | Cerracchio | |
| 2014/0021157 | A1 | 1/2014 | Gren et al. | |
| 2014/0021158 | A1 | 1/2014 | Barron | |
| 2014/0034663 | A1 | 2/2014 | Koenigseder et al. | |
| 2014/0185966 | A1 | 7/2014 | Umenaka | |
| 2014/0356480 | A1 | 12/2014 | Beaton | |
| 2015/0368010 | A1 | 12/2015 | Walker | |
| 2016/0200485 | A1 | 7/2016 | Quinones et al. | |
| 2016/0332783 | A1 | 11/2016 | Kim | |
| 2016/0347512 | A1 | 12/2016 | Horner | |
| 2017/0043918 | A1 | 2/2017 | Guo | |
| 2017/0107008 | A1 | 4/2017 | Ichikawa | |
| 2017/0175428 | A1 | 6/2017 | Quinn et al. | |
| 2018/0002077 | A1 | 1/2018 | Huggins | |
| 2018/0134462 | A1 | 5/2018 | Dreyer et al. | |
| 2018/0134469 | A1 | 5/2018 | Faria | |
| 2018/0141730 | A1 | 5/2018 | Rognard | |
| 2018/0147814 | A1 | 5/2018 | Sato et al. | |
| 2018/0312305 | A1 | 11/2018 | Rognard | |
| 2018/0362224 | A1 | 12/2018 | Philip et al. | |
| 2018/0362225 | A1 | 12/2018 | Davies | |
| 2019/0039800 | A1 | 2/2019 | Takagi et al. | |
| 2019/0270564 | A1 | 9/2019 | Umenaka | |

FOREIGN PATENT DOCUMENTS

| | | | |
|---|---|---|---|
| CN | 207524233 | U | 6/2018 |
| EP | 0055191 | A1 | 6/1982 |
| EP | 0012082 | B1 | 9/1982 |
| EP | 0172711 | A2 | 2/1986 |
| EP | 0355235 | B1 | 6/1993 |
| EP | 0698559 | A2 | 2/1996 |
| EP | 0872429 | A1 | 10/1998 |
| EP | 0703155 | B1 | 7/1999 |
| EP | 1892195 | B1 | 6/2012 |
| EP | 2666730 | A1 | 11/2013 |
| FR | 2905359 | B1 | 3/2011 |
| GB | 2149765 | B | 10/1987 |
| GB | 2249303 | A | 5/1992 |
| GB | 2269372 | A | 2/1994 |
| GB | 2323839 | B | 8/2001 |
| JP | 2001233364 | A | 8/2001 |
| JP | 2001233365 | A | 8/2001 |
| JP | 3305646 | B2 | 7/2002 |
| JP | 3380847 | B2 | 2/2003 |
| JP | 3519286 | B2 | 4/2004 |
| JP | 2004131085 | A | 4/2004 |
| JP | 2004131086 | A | 4/2004 |
| JP | 2004131087 | A | 4/2004 |
| JP | 2004231229 | A | 8/2004 |
| JP | 2004306961 | A | 11/2004 |
| JP | 3894358 | B2 | 3/2007 |
| JP | 2007204092 | A | 8/2007 |
| JP | 2008308193 | A | 12/2008 |
| JP | 4326808 | B2 | 9/2009 |
| JP | 4361497 | B2 | 11/2009 |
| JP | 4578064 | B2 | 11/2010 |
| JP | 4794175 | B2 | 10/2011 |
| JP | 4919669 | B2 | 4/2012 |
| JP | 4923177 | B2 | 4/2012 |
| JP | 5090726 | B2 | 12/2012 |
| JP | 5473419 | B2 | 4/2014 |
| JP | 2014070964 | A | 4/2014 |
| JP | 2014129104 | A | 7/2014 |
| JP | 2017109754 | A | 6/2017 |
| JP | 2017114522 | A | 6/2017 |
| JP | 3214023 | U | 12/2017 |
| KR | 20080053539 | A | 6/2008 |
| KR | 101697555 | B1 | 1/2017 |
| WO | 911267 | A2 | 5/1994 |
| WO | 9522494 | A1 | 8/1995 |
| WO | 9710155 | A1 | 3/1997 |
| WO | 9958337 | A1 | 11/1999 |
| WO | 2009000343 | A1 | 12/2008 |
| WO | 2009096585 | A1 | 8/2009 |
| WO | 2014189513 | A1 | 11/2014 |
| WO | 2018141053 | A1 | 8/2018 |
| WO | 2018178448 | A1 | 10/2018 |

* cited by examiner

FLIP-TOP CLOSURE FOR CONTAINER

TECHNICAL FIELD

The systems and apparatuses described herein generally relate to a flip-top closure for a container. The flip-top closure includes a spout and a lid pivotally coupled with the spout.

BACKGROUND

Spouted pouches typically include a flexible pouch that contains a flowable product, such as a food product. When the flexible pouch is squeezed, the product contained in the flexible pouch can be dispensed through a fitment. A cap is releasably coupled with the fitment to prevent the flowable product from being inadvertently dispensed from the flexible pouch.

BRIEF DESCRIPTION OF THE DRAWINGS

It is believed that certain embodiments will be better understood from the following description taken in conjunction with the accompanying drawings in which.

DETAILED DESCRIPTION

Figure 1:
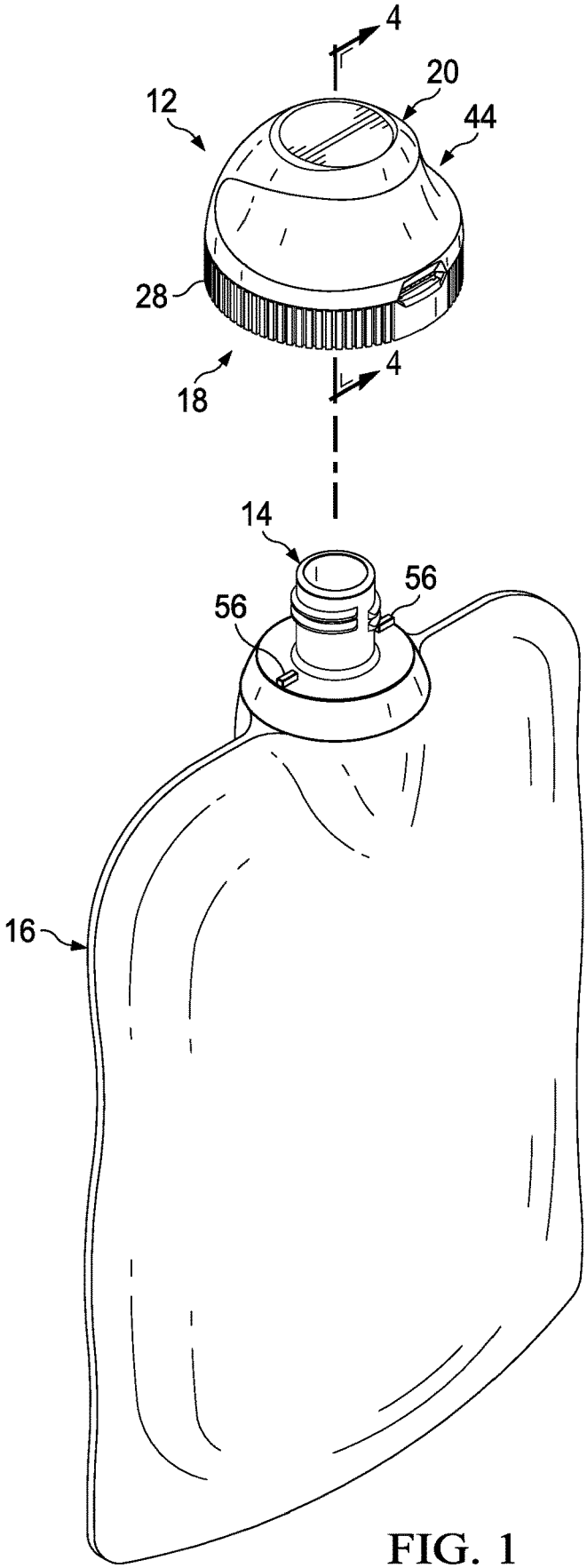
FIG. 1 is an exploded isometric view depicting a flip-top closure in association with a container, with a lid shown in a closed position, in accordance with one embodiment.

Selected embodiments are hereinafter described in detail in connection with the views and examples of FIGS. 1-10. As illustrated in FIG. 1, a flip-top closure 12 (hereinafter the "closure") can be provided on a fitment 14 of a container 16. In one embodiment, the container 16 can be a squeezable pouch that contains a flowable product, such as liquid food (e.g., baby food). When the container 16 is squeezed, the flowable product can be dispensed through the fitment 14 and out of the closure 12 for consumption by a user. It is to be appreciated that although the container 16 is shown to be a squeezable pouch, the closure 12 can be used on any of a variety of suitable alternative flexible container arrangements, such as, for example, toothpaste tubes, food or drink bottles (e.g., disposable or reusable bottles for dispensing a food or drink product) or hand cleaner dispenser bottles.

Figure 2:
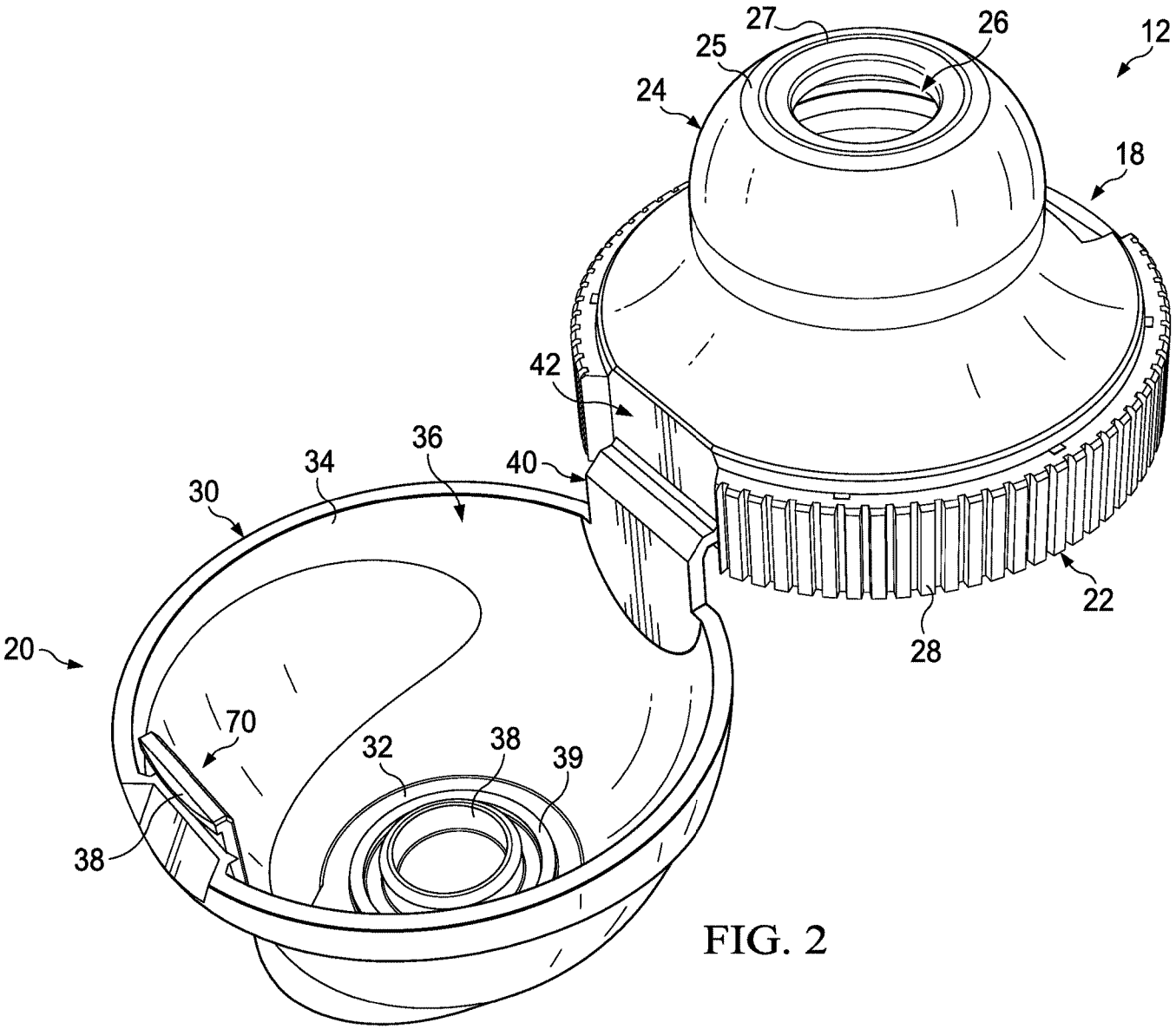
FIG. 2 is an upper isometric view depicting the flip-top closure of FIG. 1, but with the lid shown in an opened position.

As illustrated in FIG. 2, the closure 12 can include a spout 18 and a lid 20. The spout 18 can include a base portion 22 and a tip portion 24 that extends from the base portion 22. The tip portion 24 can include an upper tip wall 25 that defines a dispensation outlet 26 from which flowable product can be dispensed to a user's mouth when the container 16 is squeezed. The upper tip wall 25 can include an upper surface 27. In one embodiment, the tip portion 24 can be substantially bell-shaped (e.g., with a smaller diameter proximate the dispensation outlet 26 and a larger diameter proximate the base portion 22) and thus contoured to a user's mouth to allow for easy consumption of flowable product dispensed from the dispensation outlet 26. It is to be appreciated that any of a variety of suitable alternative shapes are contemplated for the tip portion 24 to accommodate effective dispensation to a user. The base portion 22 can include a collar 28 that is substantially annularly shaped. In one embodiment, as illustrated in FIG. 2, the collar 28 can have a knurled profile that allows for effective gripping of the collar 28 (e.g., by an automated capping machine) to facilitate attachment of the closure 12 to the fitment 14 of the container 16.

As illustrated in FIGS. 1 and 2, the lid 20 can include a main body 30 that comprises an upper lid wall 32 and a sidewall 34 that cooperates with the upper lid wall 32 to define an interior 36 (FIG. 2). A sealing member 38 (FIG. 2) can be disposed in the interior 36 and can extend away from the upper lid wall 32. A stop member 39 can be disposed adjacent to the sealing member 38 (e.g., concentric with the sealing member 38) and can extend away from the upper lid wall 32. A hinge member 40 can be coupled with each of the spout 18 and the sidewall 34. The hinge member 40 can be configured to facilitate pivoting of the lid 20 with respect to the spout 18 between a closed position (FIG. 1) and an opened position (FIG. 2). In one embodiment, the hinge member 40 can be a living hinge. As illustrated in FIG. 2, the collar 28 can define a notch 42 that is configured to accommodate the hinge member 40. When the lid 20 is in the closed position, as illustrated in FIG. 1, the hinge member 40 can be disposed in the notch 42 such that the hinge member 40 substantially corresponds with the overall profile of the collar 28. In one embodiment, as illustrated in FIG. 1, the sidewall 34 can define a finger notch 44 that accommodates a user's finger for manually pivoting the lid 20 between the opened and closed positions.

The spout 18, the lid 20, and the hinge member 40 can be formed together as a unitary one-piece construction. In one embodiment, the spout 18, the lid 20, and the hinge member 40 can be formed of a thermoplastic or elastomeric material via compression molding, injection molding, thermoforming, blow molding, three-dimensional printing, or any of a variety of other suitable alternative formation processes. In other embodiments, the spout 18, the lid 20, and the hinge member 40 can be formed of material other than thermoplastic or elastomeric material, such as paperboard, glass, rubber, elastomers, thermoset plastics, and/or metal, for example. In some embodiments, the spout 18, the lid 20, and the hinge member 40 might not be formed as a unitary one-piece construction but instead can be an assembly of discrete components.

Figure 3:
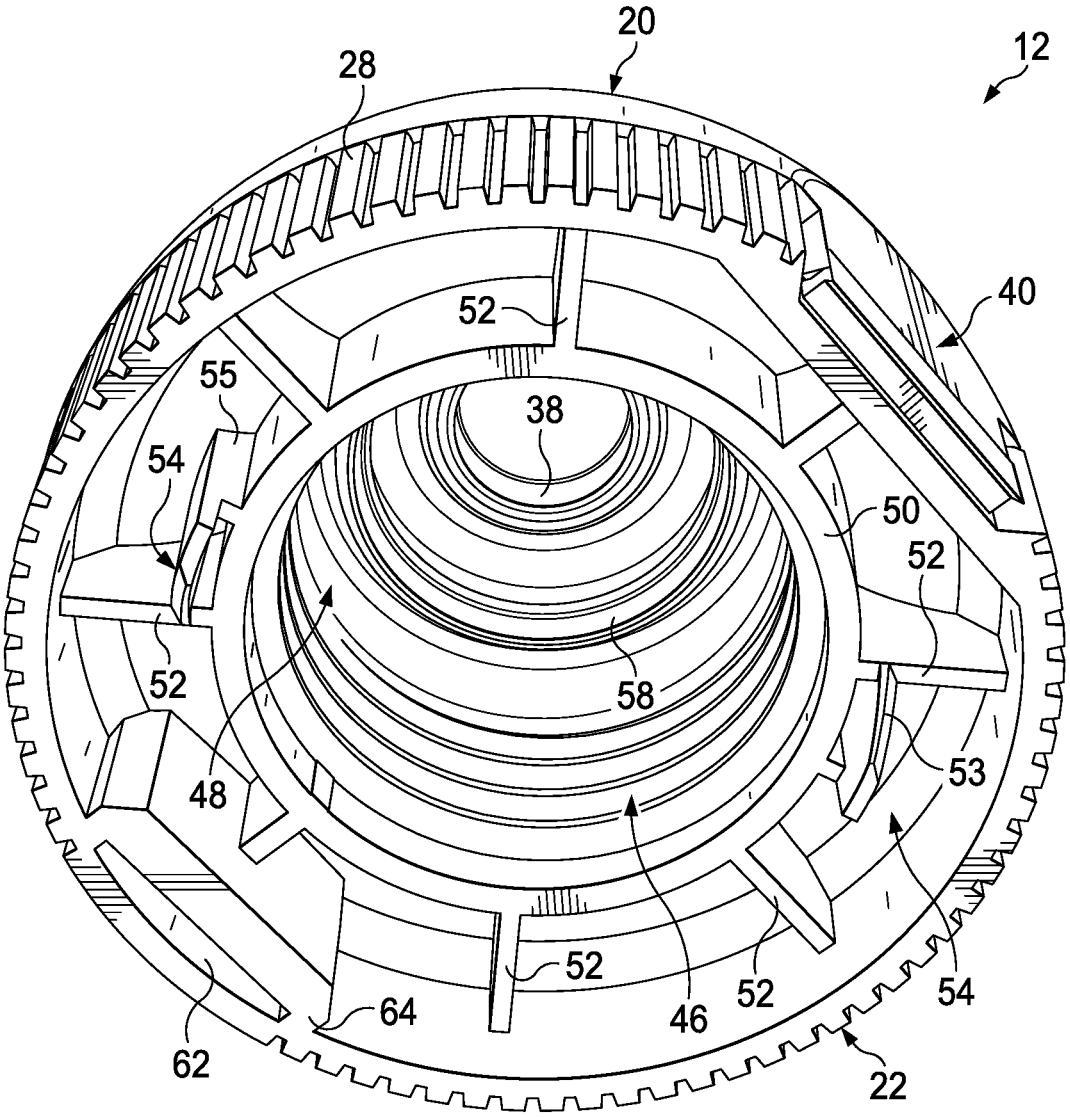
FIG. 3 is a lower isometric view depicting the flip-top closure of FIG. 1, with the lid shown in the closed position.
Figure 4:
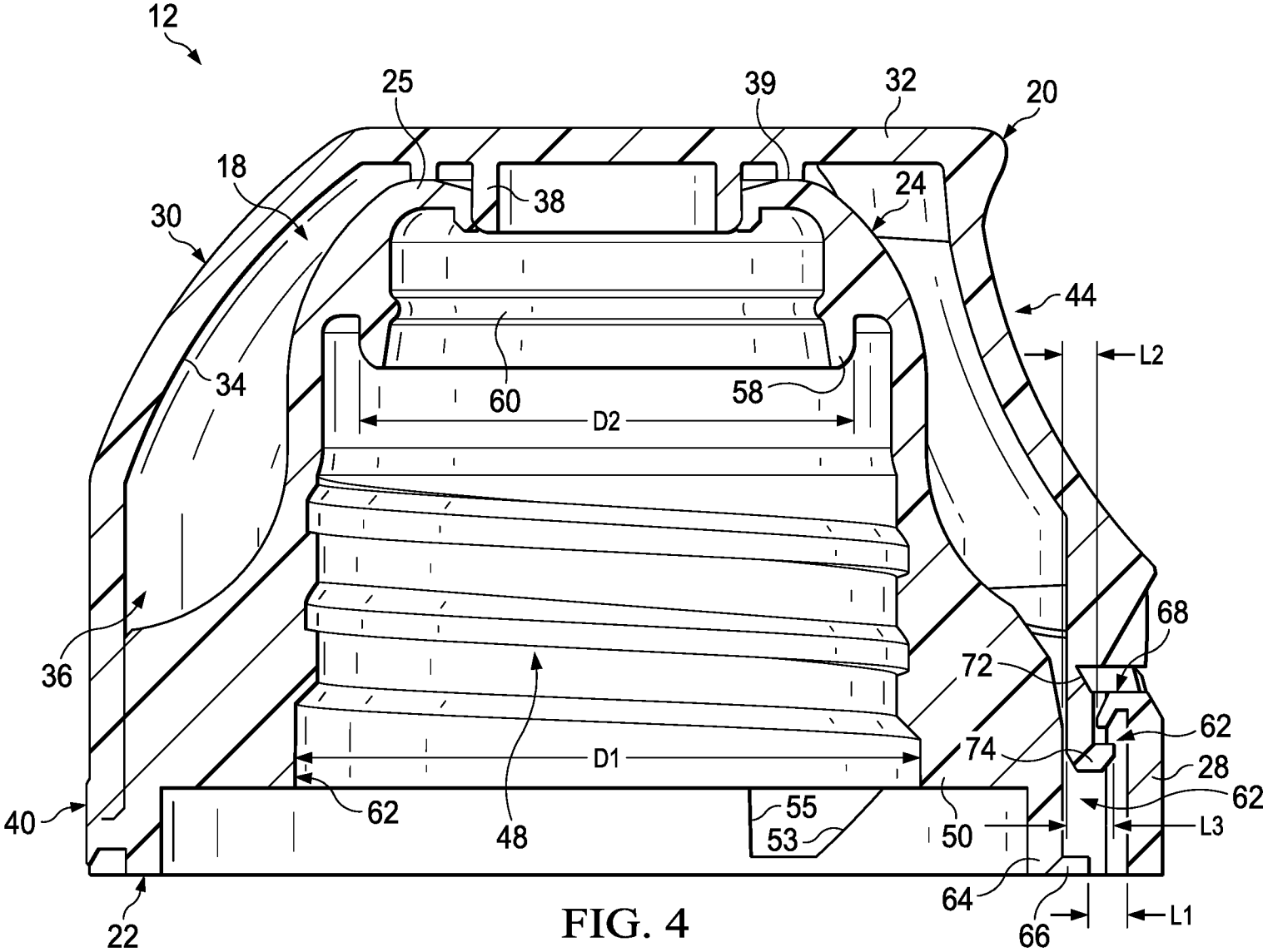
FIG. 4 is a cross-sectional view taken along the line 4-4 in FIG. 1.

Referring now to FIGS. 3 and 4, the base portion 22 of the spout 18 can define an inlet 46 that comprises a diameter D1. The base portion 22 and the tip portion 24 can cooperate to define a passageway 48 that extends between the inlet 46 and the dispensation outlet 26. When the closure 12 is coupled with the container 16, the fitment 14 can extend at least partially into the inlet 46 such that flowable product dispensed from the fitment 14 can flow through the fitment 14 and out of the dispensation outlet 26 when the lid 20 is in the opened position. When the lid 20 is in the closed position, as illustrated in FIG. 4, the upper lid wall 32 can overlie the dispensation outlet 26 and the sealing member 38 can extend into the dispensation outlet 26. The sealing member 38 can interface with the upper tip wall 25 in an interference fit which can create an effective seal therebetween while also selectively retaining the lid 20 in the closed position. The stop member 39 can contact the upper surface 27 of the upper tip wall 25 to serve as a functional stop which can ensure consistent sealing between the sealing member 38 and the upper tip wall 25 each time the lid 20 is in the closed position. The lid 20 can be pivoted from the closed position to the opened position by urging the lid 20 away from the closed position with enough force to overcome the interference fit between the upper tip wall 25 and the sealing member 38. In one embodiment, the sealing member 38 can be formed together with the lid 20 in a unitary one-piece construction. In another embodiment, the sealing member 38 can be formed separately from the lid 20 and attached with adhesive or other coupling arrangement.

In one embodiment, as illustrated in FIGS. 3 and 4, the base portion 22 can comprise a threaded collar 50 that defines the inlet 46 and is configured for threaded engagement with the fitment 14. The closure 12 can be threaded onto or off of the fitment 14 by rotating the closure 12 in a tightening or loosening direction (e.g., clockwise and counter-clockwise). It is to be appreciated that the base portion 22 can include any of a variety of suitable alternative coupling arrangements for releasably securing a fitment of a container relative to an inlet, such as a bayonet connection, for example.

As illustrated in FIG. 3, a plurality of rib members 52 can extend between the collar 28 and the threaded collar 50 to distribute some of the rotational force from the collar 28 to the threaded collar 50 when the collar 28 is grasped and rotated (e.g., to remove or install the closure 12 on the fitment 14 of the container 16). A pair of locking members 54 can extend from the threaded collar 50 and can interact with corresponding stop members 56 (FIG. 1) to facilitate alignment of the closure 12 on the container 16 as well as to serve as a tamper evident feature that indicates whether the closure 12 has been removed from the container 16 after installation. For example, when the closure 12 is tightened onto the fitment 14 of the container 16, each locking member 54 can eventually interact with one of the stop members 56. As the closure 12 is further tightened, respective angled surfaces 53 of the locking members 54 can travel over the corresponding stop members 56 until the locking members 54 clear the respective stop members 56 thereby indicating that the closure 12 is sufficiently tightened and is properly aligned on the container 16 (e.g., in a position that is convenient for a user to open the lid 20 and consume flowable material from the closure 12). If the closure 12 is subsequently loosened (e.g., by rotating the closure 12 in a counter-clockwise direction), respective vertical surfaces 55 of the locking members 54 can interface with the stop members 56 to restrict loosening of the closure 12. If the closure 12 is further loosened, the locking members 54 can break against the stop members 56 to provide a visual indication that the closure 12 has been removed from the container 16 (e.g., tampered with). It is to be appreciated that, during a filling and capping process, each time a closure (e.g., 12) is installed on a container (e.g., 16), the locking members 54 and the stop members 56 can cooperate to facilitate consistent and repeatable positioning of each closure on a given container (e.g., 16). It is also to be appreciated that, although two locking members 54 and two stop members 56 are illustrated, any quantity (e.g., one or more than two) of locking members 54 and stop members 56 are contemplated.

Still referring to FIGS. 3 and 4, the tip portion 24 can comprise an annular shoulder 58 that is disposed in the passageway 48 adjacent the dispensation outlet 26. The annular shoulder 58 can extend from the upper tip wall 25 towards the inlet 46 and can comprise a diameter D2 that is less than the diameter D1 of the inlet 46. An internal rib member 60 can extend radially inwardly from the annular shoulder 58.

Figure 5:
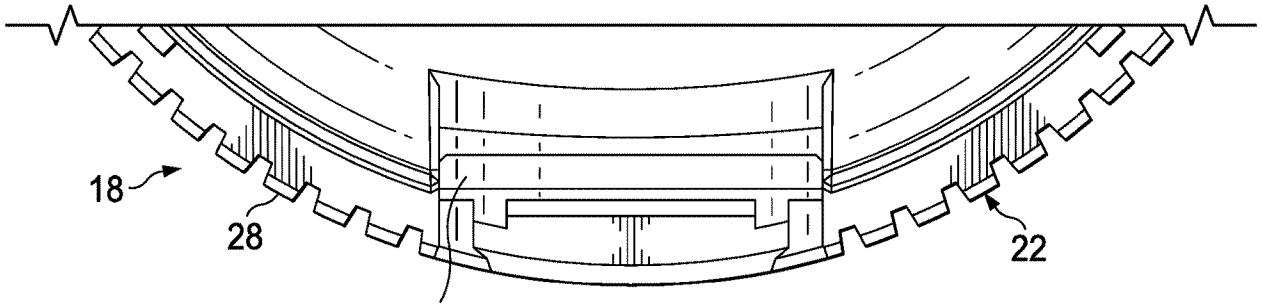
FIG. 5 is an enlarged top plan view depicting a spout of the flip-top closure of FIG. 1.

Referring now to FIGS. 3-5, the base portion 22 of the spout 18 can define a retention receptacle 62 on an opposite side of the spout 18 from the hinge member 40. As illustrated in FIGS. 3 and 4, the base portion 22 of the spout 18 can include an interior sidewall 64 that extends along a portion of the collar 28 and cooperates with the collar 28 to define the retention receptacle 62. As illustrated in FIGS. 4 and 5, the interior sidewall 64 can include a floor portion 66 that extends towards the collar 28 and is spaced from the collar by a distance L1 (FIG. 4). As illustrated in FIG. 4, the base portion 22 can include a flange member 68 that is disposed in the retention receptacle 62 and extends from the collar 28 towards the interior sidewall 64. The flange member 68 can be spaced from the interior sidewall 64 by a distance L2.

Figure 6:
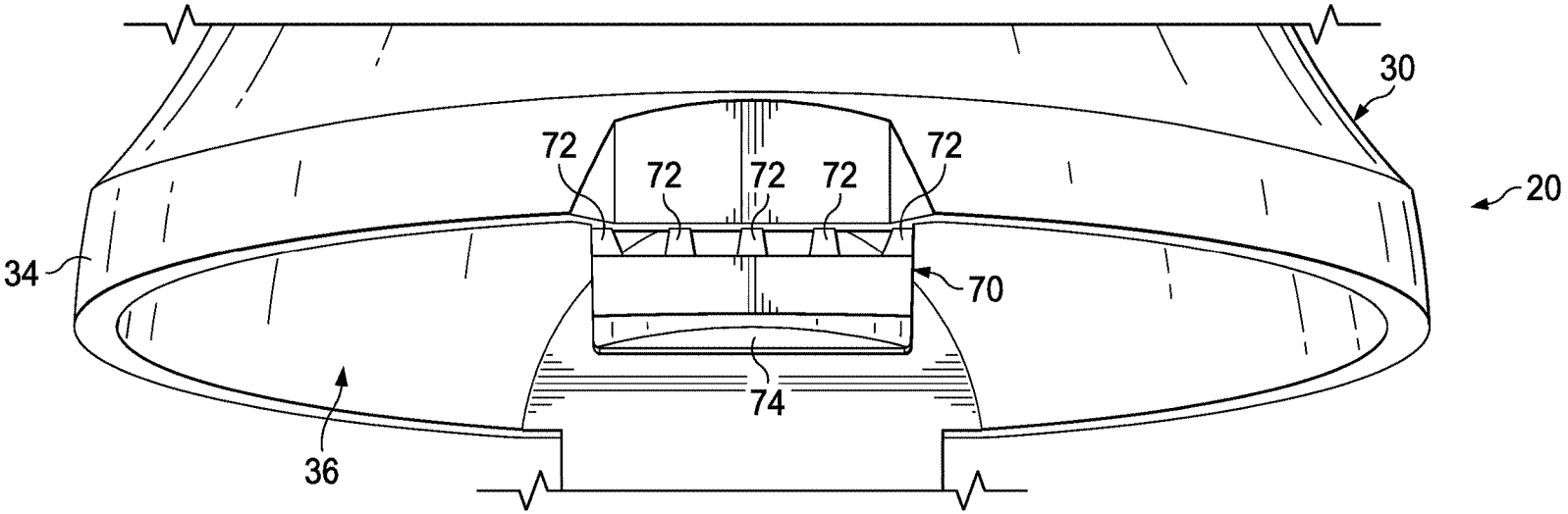
FIG. 6 is an enlarged front isometric view depicting the lid of the flip-top closure of FIG. 1.

Referring now to FIGS. 2, 4, and 6, the lid 20 can comprise a tamper evident feature 70 and a plurality of frangible members 72 (FIG. 6). The tamper evident feature 70 can extend away from the sidewall 34. The plurality of frangible members 72 can be coupled to each of the sidewall 34 and the tamper evident feature 70. As will be described in further detail below, the plurality of frangible members 72 can serve as a frangible connection between the sidewall 34 and the tamper evident feature 70 such that the tamper evident feature 70 can be torn away from the sidewall 34 when the lid 20 is opened. In one embodiment, as illustrated in FIG. 6, each of the frangible members 72 can have a substantially trapezoidal cross-sectional shape that have an upper frangible connection. It is to be appreciated that one or more frangible members can be provided in any of a variety of shapes, sizes, and/or configurations.

Figure 7:
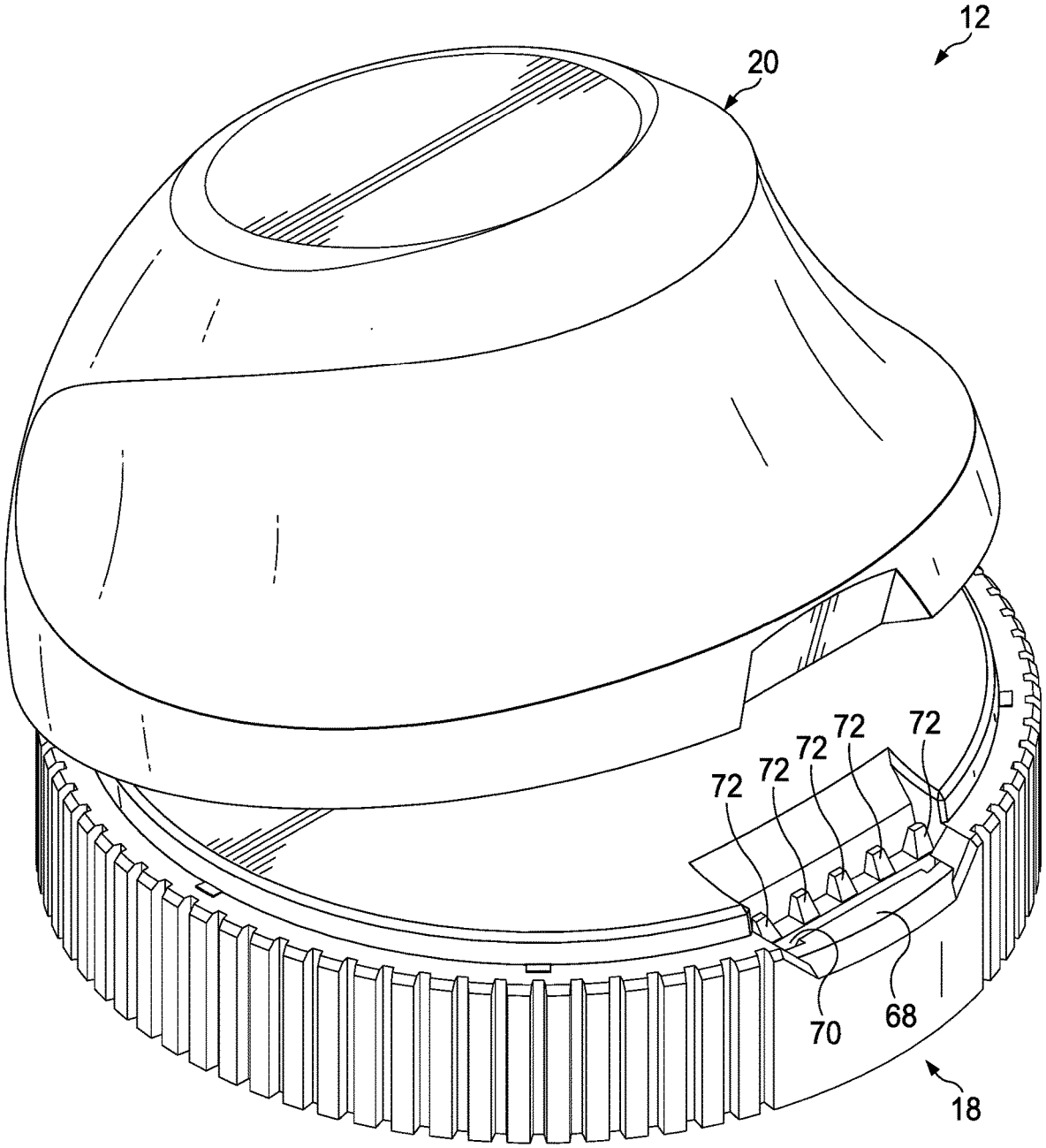
FIG. 7 is a front isometric view depicting the lid of the flip-top closure of FIG. 1, but in a partially opened position with a tamper evident feature inserted into the spout and separated from the lid.

The tamper evident feature 70 can include a finger member 74. When the lid 20 is in the closed position, as illustrated in FIG. 4, the tamper evident feature 70 can extend into the retention receptacle 62 such that the finger member 74 is disposed beneath the flange member 68 of the base portion 22. The finger member 74 and the flange member 68 can interact with each other to prevent the tamper evident feature 70 from being pulled out of the retention receptacle 62. As such, when the frangible members 72 are intact, the finger member 74 and the flange member 68 can cooperate to maintain the lid 20 in the closed position. However, when the lid 20 is pivoted from the closed position into the opened position, the finger member 74 and the flange member 68 can cooperate to irreversibly decouple the tamper evident feature 70 from the lid 20 at the frangible members 72 to provide a visual indication, and in some cases an audible indication, that the lid 20 has been opened, as illustrated in FIG. 7. A user of the closure 12 can accordingly rely on the tamper evident feature 70 to determine whether the closure 12 may have been tampered with or previously opened.

In one embodiment, when the lid 20 is in the closed position, as illustrated in FIG. 4, the finger member 74 and the flange member 68 can be spaced vertically from each other. As such, when the lid 20 is moved from the opened position, to begin opening the lid 20, the finger member 74 can move upwardly slightly before engaging the flange member 68 which can allow the lid 20 to gain momentum to encourage tearing of the tamper evident feature 70 from the lid 20.

Once the tamper evident feature 70 has been separated from the lid 20, the collar 28 and the interior sidewall 64 can cooperate to retain the tamper evident feature 70 in the retention receptacle 62 which can reduce the risk of the tamper evident feature becoming dislodged from the lid 20 and possibly becoming a choking hazard. The finger member 74 can have a thickness L3 that is greater than the distances L1 and L2. Even though the finger member 74 is thicker than the distance L2 between the flange member 68 and the interior sidewall 64, the overall shape of the finger member 74 and/or the compliance of the material used for the closure 12 can allow the tamper evident feature 70 to be inserted into the retention receptacle 62 (e.g., during assembly of the closure 12). However, once the tamper evident feature 70 is inserted into the retention receptacle 62 and then separated from the lid 20, the relative thickness L3 of the finger member 74 as compared with the distances L1 and L2 can effectively trap the tamper evident feature 70 within the retention receptacle 62.

Figure 8:
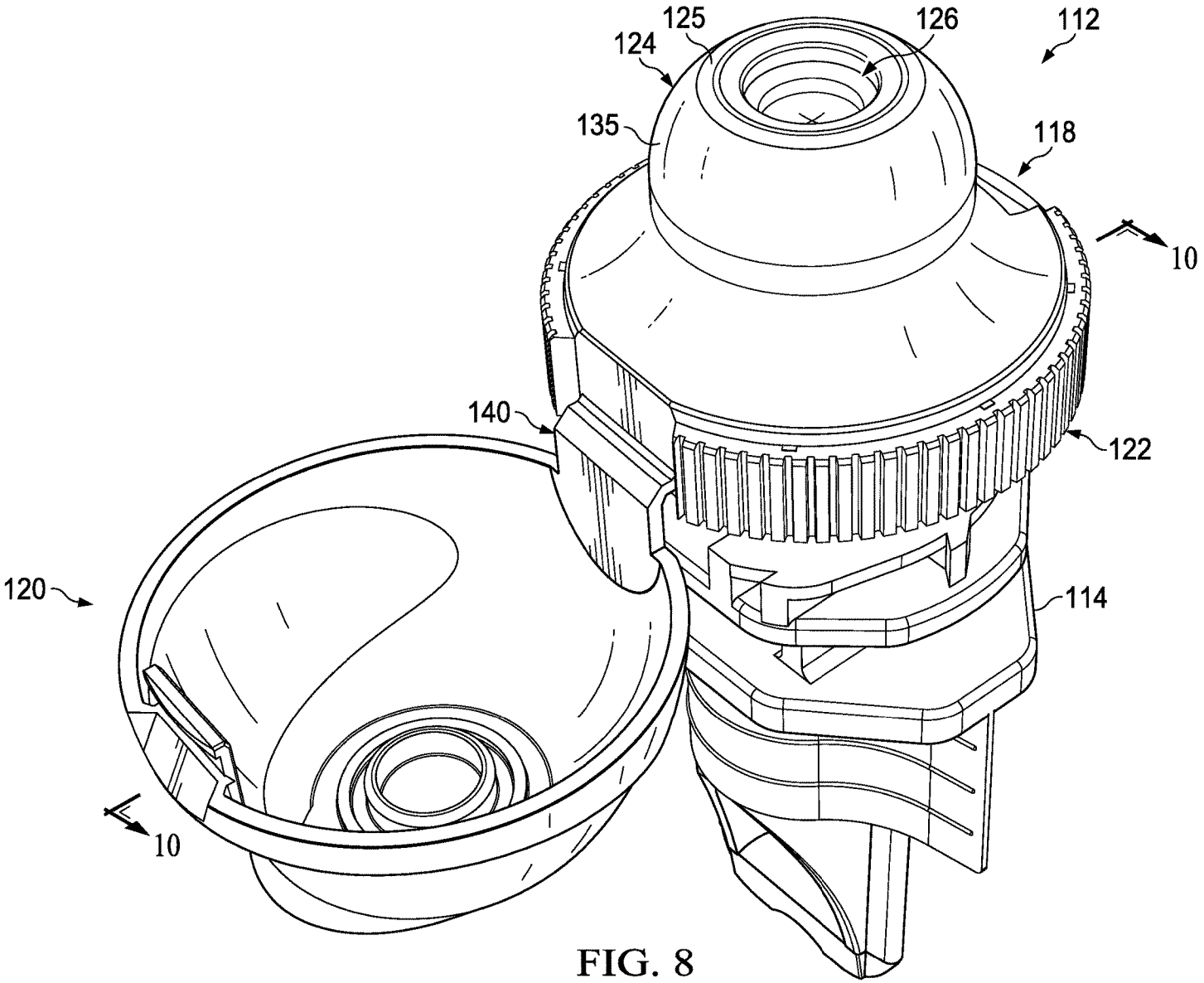
FIG. 8 is an isometric view depicting a flip-top closure and a fitment, with a lid of the flip-top closure shown in an opened position, in accordance with another embodiment.
Figure 9:
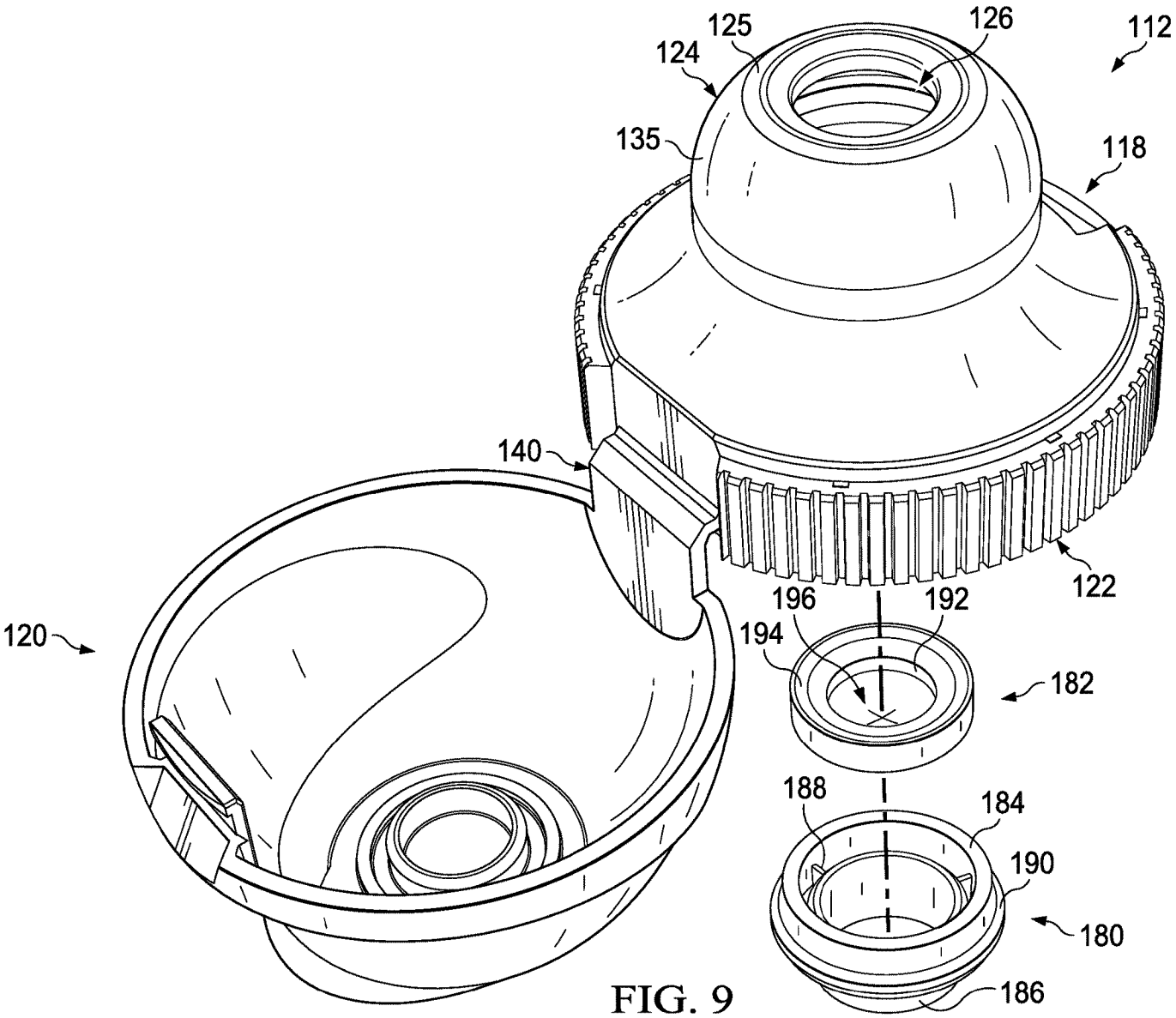
FIG. 9 is an exploded isometric view depicting the flip-top closure of FIG. 8, with the lid shown in the opened position and the fitment removed for clarity of illustration.
Figure 10:
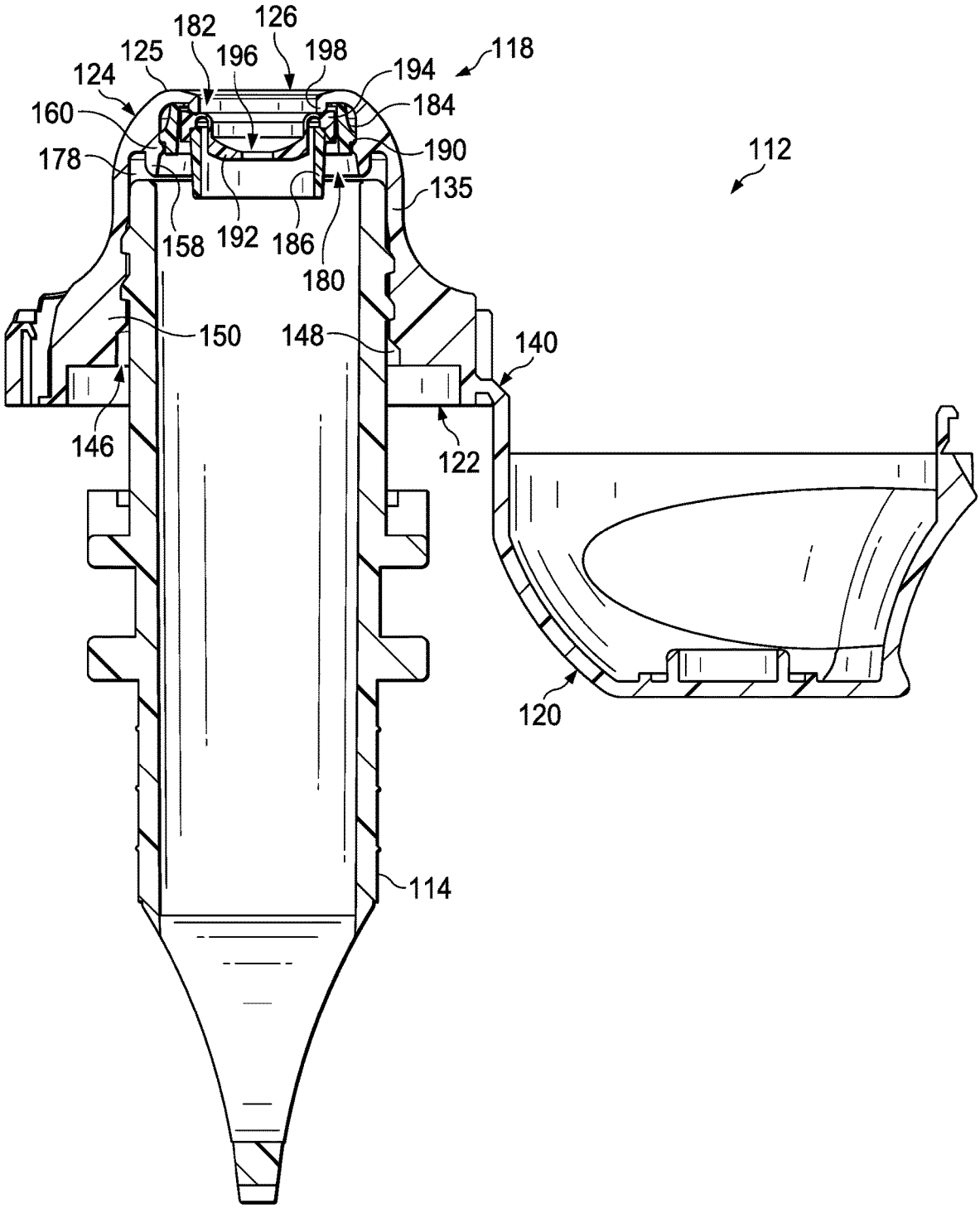
FIG. 10 is a cross-sectional view taken along the line 10-10 in FIG. 8.

An alternative embodiment of a closure 112 is illustrated in FIGS. 8-10 and is similar to, or the same in many respects as, the closure 12 illustrated in FIGS. 1-7. For example, the closure 112 can include a spout 118, a lid 120, and a hinge member 140 coupled with each of the spout 118 and the lid 120. The spout 118 can include a base portion 122 and a tip portion 124. The tip portion 124 can include an upper tip wall 125 that defines a dispensation outlet 126. As illustrated in FIG. 10, the base portion 122 can comprise a threaded collar 150 that defines an inlet 146. A passageway 148 can extend between the dispensation outlet 126 and the inlet 146. An annular shoulder 158 can be disposed in the passageway 148 and can extend from the upper tip wall 125 towards the inlet 146. An internal rib member 160 can extend radially inwardly from the annular shoulder 158. A fitment 114 of a container (not shown) can be threadably coupled with the threaded collar 150 and can extend into the passageway 148. The fitment 114 can extend into an annular groove 178 defined between the annular shoulder 158 and a sidewall 135 of the tip portion 124. The fitment 114 can engage the tip portion 124 in the annular groove 178 to create a sealing interface therebetween.

However, as illustrated in FIGS. 9 and 10, a retaining member 180 and a flexible membrane 182 can be associated with the closure 112. The retaining member 180 can comprise an outer collar 184 and an inner collar 186 disposed radially inwardly of the outer collar 184. The outer collar 184 can have a larger diameter than the inner collar 186. The outer collar 184 and the inner collar 186 can be coupled together with a plurality of rib members 188 (two shown) that extend therebetween. The outer and inner collars 184, 186 can be vertically offset from each other such that the outer collar 184 is elevated with respect to the inner collar 186 (see FIG. 10). An external rib member 190 can extend radially outwardly from the outer collar 184.

The retaining member 180 can be formed together as a unitary one-piece construction. In one embodiment, the retaining member 180 can be formed of a thermoplastic via extrusion, injection molding, thermoforming, blow molding, three-dimensional printing, or any of a variety of other suitable alternative thermoplastic formation processes. In some embodiments, the retaining member 180 might instead be formed of an assembly of discrete components.

Still referring to FIGS. 9 and 10, the flexible membrane 182 can comprise a dispensation body 192 and a gasket 194 coupled with and surrounding the dispensation body 192. The dispensation body 192 can define a slotted port 196. In one embodiment, the flexible membrane 182 can be formed of an elastomeric material, such as rubber or silicone, but in other embodiments can be formed of any of a variety of suitable alternative flexible materials.

Referring now to FIG. 10, the flexible membrane 182 can be disposed in the passageway 148 adjacent to the upper tip wall 125. The dispensation body 192 can be located beneath the dispensation outlet 126 such that the dispensation outlet 126 and the slotted port 196 are in fluid communication with each other. The retaining member 180 can be disposed in the passageway 148 adjacent to the flexible membrane 182 such that at least a portion of the flexible membrane 182 is sandwiched between upper tip wall 125 and the retaining member 180. In one embodiment, as illustrated in FIG. 10, the gasket 194 can be sandwiched between the inner collar 186 and a collar portion 198 of the upper tip wall 125.

The retaining member 180 can be coupled with the annular shoulder 158 to facilitate retention of the flexible membrane 182 within the tip portion 124. In one embodiment, as illustrated in FIG. 10, the retaining member 180 can fit onto the annular shoulder 158 such that the internal rib member 160 of the annular shoulder 158 and the external rib member 190 of the outer collar 184 interface with each other to couple the retaining member 180 to the annular shoulder 158. In such an embodiment, the internal rib member 160 and the external rib member 190 can cooperate to urge the inner collar 186 and the collar portion 198 together enough to compress the gasket 194 thereby creating an effective seal therebetween. During assembly of the closure 112, the flexible membrane 182 can be installed in the tip portion 124 by simply pressing the retaining member 180 onto the annular shoulder 158 over the flexible membrane 182, which can be more cost effective and efficient than conventional flip-top closures that incorporate a membrane.

When flowable product is not being dispensed from the closure 112, the flexible membrane 182 can be provided in a concave shape, as illustrated in FIGS. 8 and 10. When the container (e.g., 16) is squeezed to dispense flowable product from the closure 112, the flexible membrane 182 can flex upwardly and into a convex shape to allow the flowable product to be dispensed through the slotted port 196. When the container is released to stop dispensing flowable product, the flexible membrane 182 can be returned to the concave shape and the flowable product can be slightly withdrawn back into the fitment 114. It is to be appreciated that the retaining member 180 can be any of a variety of suitable alternative arrangements that facilitates coupling of the flexible membrane 182 to the tip portion 124. It is also to be appreciated that the flexible membrane 182 can be any of a variety of suitable alternative arrangements for controlling dispensation of flowable product from the dispensation outlet 126.

It is to be appreciated that, in one embodiment, the closures 12, 112 illustrated in FIGS. 1-7 and 8-10, respectively, can be cross-compatible such that any closure can be converted into the arrangement shown in FIGS. 1-7 or the assembly shown in FIGS. 8-10 by simply omitting or adding, respectively, the retaining member 180 and the flexible membrane 182. This cross-compatible configuration can provide a more cost effective and efficient solution for implementing or omitting a membrane on a closure than conventional closure configurations which utilize different closure designs depending upon whether a membrane is being implemented or not.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A flip-top closure for a container, the flip-top closure comprising:

a spout configured for coupling with a fitment of a container, the spout comprising:

a base portion defining a retention receptacle and an inlet, wherein the inlet comprises a first diameter; and a tip portion extending from the base portion and defining a dispensation outlet, wherein the base portion and the tip portion cooperate to define a passageway that extends between the inlet and the dispensation outlet;

a lid comprising:

a main body comprising an upper lid wall and a sidewall that cooperate to define an interior;

a tamper evident feature extending away from the sidewall; and at least one frangible member coupled with each of the sidewall and the tamper evident feature; and a hinge member coupled with each of the spout and the sidewall of the main body, the hinge member configured to facilitate pivoting of the lid between a closed position and an opened position, wherein:

when the lid is in the closed position, the upper lid wall overlies the dispensation outlet to provide a fluid seal therebetween, and the tamper evident feature extends into the retention receptacle;

when the lid is pivoted from the closed position to the opened position, the tamper evident feature is decoupled from the lid at the at least one frangible member and is retained within the retention receptacle;

the tamper evident feature comprises a finger member;

the base portion comprises a flange member disposed in the retention receptacle;

when the lid is moved from the closed position to the opened position, the finger member and the flange member cooperate to facilitate decoupling of the tamper evident feature at the at least one frangible member from the lid;

the base portion comprises a collar and an interior wall that extends along a portion of the collar and cooperates with the collar to define the retention receptacle;

the interior wall comprises a floor portion that extends towards the collar and is configured to facilitate retention of the flange member within the retention receptacle; and the floor portion is spaced from the collar by a first distance and the finger member has a thickness that is greater than the first distance.

2. The flip-top closure of claim 1 wherein the flange member extends from the collar and is spaced from the interior wall by a second distance, and the thickness of the finger member is greater than the second distance.

3. The flip-top closure of claim 1 wherein the base portion comprises a threaded collar that defines the inlet and is configured for threaded engagement with a fitment of a container.

4. The flip-top closure of claim 1 wherein the tip portion further comprises an upper tip wall that defines the dispensation outlet.

5. The flip-top closure of claim 4 wherein the tip portion further comprises an annular shoulder that extends from the upper tip wall towards the inlet and comprises a second diameter that is shorter than the first diameter.

6. The flip-top closure of claim 5 wherein the tip portion further comprises an internal rib member that extends radially inwardly from the annular shoulder.

7. The flip-top closure of claim 1 wherein the lid further comprises a sealing member that is disposed in the interior and extends away from the upper lid wall, wherein the sealing member extends at least partially into the dispensation outlet when the lid is in the closed position.

8. The flip-top closure of claim 1 further comprising:

a flexible membrane disposed in the passageway adjacent the dispensation outlet; and a retaining member, wherein:

the tip portion comprises an upper tip wall that defines a dispensation outlet and an annular shoulder that extends from the upper tip wall towards the inlet; and the retaining member is disposed in the passageway adjacent the flexible membrane such that at least a portion of the flexible membrane is sandwiched between the retaining member and the upper tip wall.

9. The flip-top closure of claim 8 wherein the retaining member comprises an outer collar and an inner collar coupled with the outer collar and disposed radially inwardly of the outer collar.

10. The flip-top closure of claim 9 wherein:

the tip portion comprises an internal rib member that extends radially inwardly from the annular shoulder; and the retaining member comprises an external rib member that extends radially outwardly from the outer collar and interfaces with the internal rib member to facilitate coupling of the retaining member with the annular shoulder.

11. The flip-top closure of claim 10 wherein the flexible membrane comprises a dispensation body and a gasket coupled with and surrounding the dispensation body.

12. The flip-top closure of claim 11 wherein the gasket is disposed between each of the inner collar, the outer collar, and the upper tip wall to facilitate an effective seal therebetween.

13. An assembly comprising:

a flip-top closure for a container, the flip-top closure comprising:

a spout configured for coupling with a fitment of a container, the spout comprising:

a base portion defining a retention receptacle and an inlet, wherein the inlet comprises a first diameter; and a tip portion extending from the base portion and comprising:

an upper tip wall that defines a dispensation outlet, wherein the base portion and the tip portion cooperate to define a passageway that extends between the inlet and the dispensation outlet; and an annular shoulder that extends from the upper tip wall towards the inlet and comprises a second diameter that is shorter than the first diameter;

a lid comprising:

a main body comprising an upper lid wall and a sidewall that cooperate to define an interior; and a tamper evident feature extending away from the sidewall; and at least one frangible member coupled with each of the sidewall and the tamper evident feature; and a hinge member coupled with each of the spout and the sidewall of the main body, the hinge member configured to facilitate pivoting of the lid between a closed position and an opened position;

a flexible membrane disposed in the passageway adjacent the dispensation outlet; and a retaining member disposed in the passageway adjacent the flexible membrane such that at least a portion of the flexible membrane is sandwiched between the retaining member and the upper tip wall, wherein:

when the lid is in the closed position, the upper lid wall overlies the dispensation outlet to provide a fluid seal therebetween, and the tamper evident feature extends into the retention receptacle;

when the lid is pivoted from the closed position to the opened position, the tamper evident feature is decoupled from the lid at the at least one frangible member and is retained within the retention receptacle;

the tamper evident feature comprises a finger member;

the base portion comprises:

a flange member disposed in the retention receptacle;

a collar; and an interior wall that extends along a portion of the collar and cooperates with the collar to define the retention receptacle, the interior wall comprising a floor portion that extends towards the collar and is configured to facilitate retention of the flange member within the retention receptacle;

when the lid is moved from the closed position to the opened position, the finger member and the flange member cooperate to facilitate decoupling of the tamper evident feature at the at least one frangible member from the lid;

the floor portion is spaced from the collar by a first distance and the finger member has a thickness that is greater than the first distance; and the flange member extends from the collar and is spaced from the interior wall by a second distance, and the thickness of the finger member is greater than the second distance.

14. The assembly of claim 13 wherein:

the retaining member comprises an outer collar and an inner collar coupled with the outer collar and disposed radially inwardly of the outer collar;

the tip portion comprises an internal rib member that extends radially inwardly from the annular shoulder;

the retaining member comprises an external rib member that extends radially outwardly from the outer collar and interfaces with the internal rib member to facilitate coupling of the retaining member with the annular shoulder;

the flexible membrane comprises a dispensation body and a gasket coupled with and surrounding the dispensation body; and the gasket is disposed between each of the inner collar, the outer collar, and the upper tip wall to facilitate an effective seal therebetween.

15. A kit comprising a container and the assembly of claim 13.

* * * * *